United States Patent [19]

Feeney, III

[11] Patent Number: 4,699,663

[45] Date of Patent: Oct. 13, 1987

[54] SIZING COMPOSITION AND METHOD

[75] Inventor: George F. Feeney, III, Pensacola, Fla.

[73] Assignee: Reichhold Chemicals, Inc., White Plains, N.Y.

[21] Appl. No.: 878,032

[22] Filed: Jun. 24, 1986

[51] Int. Cl.[4] ..... C08L 93/04; D21H 3/02; D21H 3/32

[52] U.S. Cl. ..... 106/218; 8/115.6; 106/236; 106/238; 162/158; 162/160; 162/169

[58] Field of Search ..... 106/218, 236, 238; 162/158, 160, 169; 8/115.6

[56] References Cited

U.S. PATENT DOCUMENTS

| | | | |
|---|---|---|---|
| 2,665,983 | 12/1954 | Bakalar et al. | 106/218 |
| 2,771,464 | 11/1956 | Hastings et al. | 106/218 |
| 4,022,634 | 5/1977 | Emerson et al. | 106/218 |
| 4,025,354 | 5/1977 | Emerson et al. | 106/218 |
| 4,056,430 | 11/1977 | Hoeger et al. | 162/158 |
| 4,093,779 | 6/1978 | Emerson et al. | 428/498 |
| 4,141,750 | 2/1979 | Emerson et al. | 106/218 |
| 4,207,215 | 6/1980 | Bolan | 252/DIG. 11 |
| 4,483,744 | 11/1984 | Emerson, Sr. | 106/218 |
| 4,591,412 | 5/1986 | Hechler | 162/158 |
| 4,605,445 | 8/1986 | Abell et al. | 106/236 |

*Primary Examiner*—Paul Lieberman
*Assistant Examiner*—Linda D. Skaling
*Attorney, Agent, or Firm*—Rodman & Rodman

[57] ABSTRACT

An improved sizing composition resistant to hard water precipitation comprises a first component containing a reaction product of urea and an aminocarboxylic acid and a second component comprising a rosin. A process for preparing the improved sizing composition is also disclosed.

34 Claims, 3 Drawing Figures

TURBIDITY VERSUS TIME FOR 5% DILUTIONS OF SIZING AGENTS WITH 25 PPM $CaCO_3$ HARDNESS WATER

TURBIDITY VERSUS TIME FOR 5% DILUTIONS OF SIZING AGENTS WITH 25 PPM $CaCO_3$ HARDNESS WATER

TURBIDITY VERSUS TIME FOR 5% DILUTIONS OF SIZING AGENTS WITH 100 PPM $CaCO_3$ HARDNESS WATER

SIZING COMPOSITION AND METHOD

BACKGROUND OF THE INVENTION

1. Field of the Invention

The present invention relates to an improved sizing composition and method for its preparation.

2. Description of the Prior Art

In the papermaking process, sizing agents are generally included to make the finished paper product resistant to liquid penetration. This is generally accomplished by two alternative approaches. In the first approach, the sizing agent can be added to the papermaking process pulp slurry and is referred to as an "internal sizing agent." In the second approach, the sizing agent can be applied as a coating to the surface of the paper after it has been formed and partially dried.

In internal sizing, the sizing agent is dispersed through the pulp fibers before sheet formation. In this manner, a uniform distribution of the sizing agent exists throughout the fiber matrix of the resulting paper product.

One of the most widely used and effective sizing agents is rosin. Rosin is a complex mixture of about 90% resin acids and about 10% neutral matter. Rosin is insoluble in water in the free or uncombined state.

Rosin size is generally made by neutralizing or saponifying the rosin with one or both of the common alkalis, potassium or sodium hydroxide. The potassium and sodium salts of rosin are readily dispersed in water and concentrated solutions of these materials provide useful sizing agents for wood pulp that is used in paper making.

Several U.S. patents disclose that rosin based sizing compositions are improved with the addition of a reaction product of urea and an acid. The reaction product of urea and an acid increases the total acidity of the resulting sizing compositions. The increased total acidity, which is greater than that of the rosin size alone is believed responsible for the superiority of these compositions over those of the prior art.

U.S. Pat. Nos. 4,022,634 and 4,093,779 to Emerson et al disclose the reaction product of urea with acids such as sulfamic, phosphoric, oxalic, methane-sulfonic, trichloracetic, nitric, sulfuric, hydrochloric, stearic, and acetic. U.S. Pat. No. 4,025,354 to Emerson et al focuses upon the urea-sulfamic acid reaction. U.S. Pat. No. 4,141,750 to Emerson et al and U.S. Pat. No. 4,483,744 to Emerson discloses the reaction product of urea and at least one Lewis acid from the group including sulfuryl chloride, chloro-sulfonic acid, thionyl chloride, benzenesulfonyl chloride, benzenesulfonic acid, ortho-toluenesulfonic acid, para-toluenesulfonic acid, ortho-toluenesulfonyl chloride and para-toluenesulfonyl chloride. U.S. Pat. No. 4,437,894 to Emerson discloses the reaction product of urea and formic acid.

Also of interest is U.S. Pat. No. 2,665,983 to Bakalar et al which discloses sizing agents composed of hydrocarbons in the presence of a polyphosphoric acid compound, preferably together with a mutual solvent for the polyphosphoric acid compound and the sizing agent used. U.S. Pat. No. 2,771,464 to Hastings et al. discloses the use of fortifying agents useful for enhancing the effect of rosin size in the manufacture of sized paper. The fortifying agent is comprised of the reaction product of rosin, maleic anhydride, and dehydrated citric acid. U.S. Pat. No. 1,904,251 to Rafton discloses the use of citric acid or other soluble citrates such as sodium, potassium or ammonium citrate as precipitation inhibitors for aluminum compounds, such as aluminum hydroxide or hydrate for the purpose of preventing sticking of the stock on the paper machine.

In internal sizing with rosin, co-addition of aluminum sulfate is necessary to produce the sizing effect. The aluminum ions react with rosin to form aluminum rosinate, a cationic hydrophobic material that absorbs onto the oppositely charged cellulose fibers. Aluminum ions can also be furnished by other equivalent compounds such as aluminum chloride and sodium aluminate.

To facilitate the dispersion of the sizing agent and enhance the sizing effect, it is desirable to dilute the sizing solutions with water before introduction to the paper-making process. Unfortunately, the reaction of rosin with polyvalent cations is not limited to aluminum. Calcium and magnesium ions, two common constituents of hard water, also compete with aluminum ions and react with rosin to produce insoluble salts. The insoluble calcium and magnesium salts are virtually ineffective as sizing agents and render the rosin acids inactive to aluminum ions. Thus, the competition of the calcium and magnesium ions with aluminum ions for rosin acids results in a decrease in available rosin and reduced sizing effectiveness.

In addition, the use of hard water for diluting rosin size can render the sizing agent prone to precipitation. In mild cases this tendency to precipitate is limited to the formation of turbid size "teas" or dilutions. Generally, if turnover of the turbid material is rapid, other more serious effects can be minimized. However, if the turbid material in the size composition is allowed to settle, or if excessively hard water is used, insoluble calcium and magnesium rosinate can precipitate and form deposits in storage tanks and feed lines which can obstruct the delivery of the size system to paper machines. This results in loss of sizing in the paper produced. Thus, a sizing agent that is resistant to precipitation in hard water, is desirable

SUMMARY OF THE INVENTION

The present invention relates to an improved sizing composition comprising a first component containing urea and an aminopolycarboxylic acid, and a second component comprising a rosin. A process for preparing the improved sizing composition is also disclosed.

BRIEF DESCRIPTION OF THE FIGURES

In the accompanying figures in which various embodiments of the invention are illustrated, FIGS. 1, 2 and 3 compare turbidity versus time for 5% dilutions of various sizing agents.

DESCRIPTION OF THE PREFERRED EMBODIMENTS

In accordance with the present invention, a sizing composition resistant to hard water precipitation comprises a first component containing urea and an aminocarboxylic acid and a second component comprising a rosin.

The aminopolycarboxylic acids include ethylenediaminetetraacetic acid (EDTA), diethylenetriaminepentaacetic acid (DTPA), N-hydroxyethylethylenediaminetriacetic acid (HEEDTA), nitrilotriacetic acid (NTA), and mixtures thereof. The aminopolycarboxylic acids function as chelating agents for calcium and magnesium. Thus, the presence of the aminopolycarboxylic acids in the sizing composition provides an additional advantage of rendering the sizing agent resistant to hard water precipitation.

The aminopolycarboxylic acids of the present invention differ in the stability of their respective complexes with alkaline earth cations. The stronger the complex, the more tightly bound the cation and the more resistant the sizing system is to competitive cation binding reactions such as the formation of calcium and magnesium rosinate in rosin size dilutions.

EDTA has been found to be the most effective aminopolycarboxylic acid in the sizing agent compositions of the present invention. Thus, if a stoichiometric amount of EDTA to alkaline earth cation is present, dilutions of the sizing agent will remain clear indefinitely.

The other aminopolycarboxylic acids, such as DTPA and HEEDTA produce somewhat less stable dilutions. NTA, although also effective, was found the least effective, although all of the aformentioned aminopolycarboxylic acids render the sizing agent compositions more stable than those previously known in the art. Table 1 which follows lists the specific aminopolycarboxylic acids useful in the present invention as well as molecular and equivalent weights and chelating activity.

Selection of a particular aminopolycarboxylic acid for a particular sizing composition and application depends upon such primary factors as cost and dilution stability. When the dilute size composition has rapid turnover, meaning that it does not remain stored for long periods of time in storage tanks, less expensive NTA can be used. Where longer storage life is necessary, DTPA and HEEDTA would then be the aminopolycarboxylic acids of choice. Most preferably, where indefinite storage life is necessary, EDTA is the aminopolycarboxylic acid of choice and the preferred embodiment of the invention.

Figure 1:
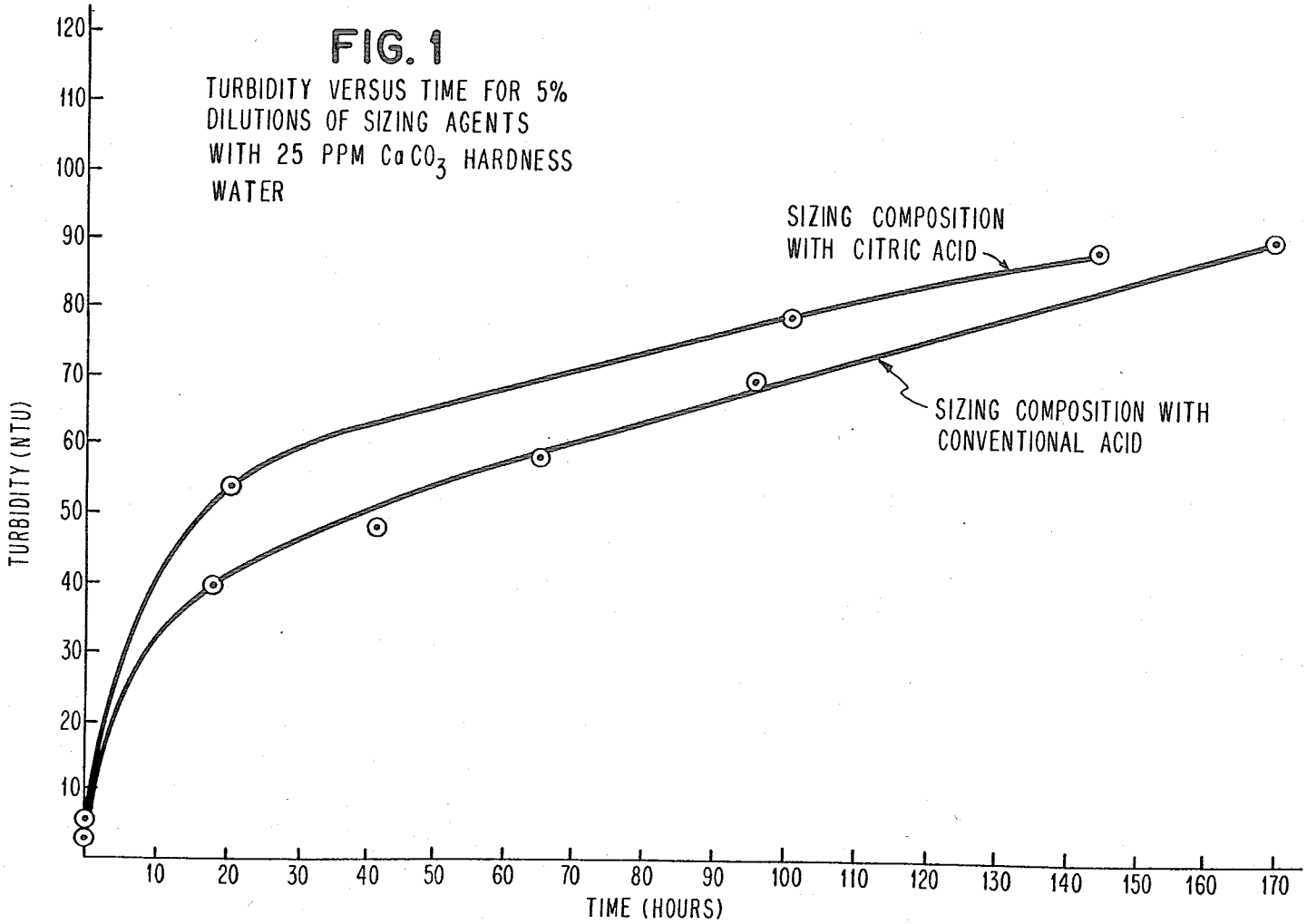

Other known acids having chelating activity, such as the alphahydroxyacids, were also explored as possible equivalents for the more expensive aminopolycarboxylic acids. Surprisingly, citric acid, a member of the alphahydroxyacid series with the greatest complex stability with calcium and magnesium was found ineffective even in stoichiometric excess. The data for this study has been plotted in FIG. 1, which shows turbidity versus time for 5% dilutions of citric acid in comparison with formic acid in hard water of 25 parts per million calcium carbonate ($CaCO_3$).

As mentioned, the first component of the sizing composition comprises urea and an aminopolycarboxylic acid. It has also been found that a portion of the aminopolycarboxylic acid under certain conditions can be substituted by one or more acids known in the art, and referred to as "conventional acids" such as carboxylic acids, including formic, acetic, trichloroacetic, oxalic and stearic acids; inorganic acids, such as hydrochloric, sulfuric, sulfamic, nitric and phosphoric; and Lewis acids such as methanesulfonic, sulfuryl chloride, chlorosulfonic, thionyl chloride, benzenesulfonyl chloride, benzenesulfonic, ortho- or para-toluenesulfonic and ortho- or para-toluenesulfonyl chloride.

Determining of the amount of aminopolycarboxylic acid in preparing the urea/acid component requires four considerations:

1. The dilution water hardness;
2. The desired dilution concentration;
3. The chelating activity of the aminopolycarboxylic acid; and
4. The quantity o the aminopolycarboxylic acid containing urea/acid reaction product in a given sizing composition.

It is necessary to know the total hardness of the dilution water in order to calculate the required quantity of aminopolycarboxylic acid needed to complex the available calcium and magnesium ions. Water hardness, in the context of the present invention is defined as the calcium and magnesium concentration, expressed as an equivalent quantity of $CaCO_3$, in milligrams per liter, i.e., parts per million (ppm), of water sample as determined in accordance with ASTM D 1126-80. Water hardness varies from very soft water containing less than 10 ppm $CaCO_3$, to greater than 500 ppm $CaCO_3$ in some locations. Water hardness as low as 25 ppm $CaCO_3$ can destabilize sizing compositions.

A related factor in determining the required quantity of aminopolycarboxylic acid is the desired dilution concentration of the sizing agent. Dilution concentration, together with water hardness, determines the total complexable cation content of the sizing system, and thus the necessary quantity of aminopolycarboxylic acid furnished by the sizing composition to render the dilution stable.

The various aminopolycarboxylic acids available differ in complex stability, and also in the amount of chelate necessary to complex a given quantity of calcium or magnesium ions. Chelating activity is the measure of the cation/chelate relationship and is defined as the quantity of cation, expressed as an equivalent quatity of $CaCO_3$, in milligrams, complexed by one gram of chelating agent. The activity is an empirically derived function of a chelate's ability to complex cations and approximates theoretical stoichiometric values within practical limits of substance purity. Chelating activity, however, does not predict complex stability. The extent of chelating activity cannot anticipate the value of a chelate in competing for a cation in the presence of a competing cation-binding reaction, such as calcium and magnesium rosinate formation. The chelating activity of some commercially available aminopolycarboxylic acids are listed in Table 1, which follows:

TABLE 1

| Aminopolycarboxylic Acid | Formula Weight gm/mole | Equivalent Weight gm/EQ | Chelating Activity mg $CaCO_3$/gm |
|---|---|---|---|
| EDTA | 292.3 | 73.1 | 340 |
| HEEDTA | 278.3 | 92.3 | 353 |
| DPTA | 393.4 | 78.73 | 253 |
| NTA | 191.2 | 63.7 | 525 |

The final consideration in determining the quantity of aminopolycarboxylic acid necessary is the proportion of chelate-containing urea/acid reaction product included in the composition. In general, the greater the contribution of the urea/acid reaction product to the total mass of the composition, the less aminopolycarboxylic acid is required. The chelating ability of sizing agents increases with higher proportions of a urea/acid reaction product of a given aminopolycarboxylic acid concentration.

All four considerations have been combined as parameters in the following equation:

$$A = \frac{10\,(100 - B/C)\,D}{(B/C)\,EF} \qquad (1)$$

where

A = required percent aminopolycarboxylic acid in urea/acid reaction product,

B = dilution concentration,

C = solids fraction of sizing composition,

D = water hardness,

E = % urea/acid reaction product in composition, and

F = chelating activity of selected aminopolycarboxylic acid.

Another important consideration in formulating the sizing agents of the present invention is the total acidity imparted by the urea/acid reaction product. The prior art, particularly the aforesaid Emerson patents, discloses that the reaction of urea with a conventional acid results in a product with increased total acidity that is higher than with the use of urea alone.

Although it is not completely understood, the increased total acidity is believed responsible for the efficacy of these compositions. The aminopolycarboxylic acids function similarly to the conventional acids and increase the total acidity of the sizing composition. However, due to the correspondingly higher cost of the aminopolycarboxylic acids, it is desirable to use only that quantity of chelate which is sufficient for a particular sizing application.

The balance of acid necessary to provide a specified minimum total acidity can then be achieved by co-addition with a less expensive conventional acid. However, in some instances, the hardness of the dilution water will be so high that all or substantially all of the acid used will be the aminopolycarboxylic acid in order to achieve the minimum total acidity and the dilution stability.

The total quantity of conventional acid and aminopolycarboxylic acid can vary, and is best defined in terms of the resulting total acidity produced. The desired minimum total acidity has been found to vary from at least about 1000 ppm and preferably about 4000 ppm. Generally, if the amount of conventional acid necessary to achieve a desired total acidity is known, and the necessary quantity of aminopolycarboxylic acid chelate has been calculated from equation (1), then the correct quantity of complex acid may be calculated in accordance with the following equation:

$$X=(Y-Z/W)t \qquad (2)$$

where

X = grams of second acid required to reach a given total acidity,

Y = total acid equivalents represented by quantity of acid, X,

Z = grams of chelate required for stable dilution,

W = equivalent weight of the chelate, and

T = equivalent weight of the second acid.

If the solution to equation (2) is positive, then the numerical value is the correct amount of conventional acid necessary in addition to the calculated amount of aminopolycarboxylic acid to achieve the minimum total acidity. If the solution to equation (2) is negative, then the minimum total acidity may be achieved with the aminopolycarboxylic acid alone. In these instances, the conventional acids can be excluded completely.

In forming the first component, urea is generally reacted with the acid at a temperature sufficient to cause a change in the pH of the mixture from an acidic pH before the reaction begins to a basic pH as the reaction is completed, as determined by a pH meter. This temperature will generally range from about 100° C. to 215° C. and is dependent to some extent upon the water content of the mixture, and may generally be higher for mixtures having a low water content.

The actual amount of acid reacted with the urea is generally at least about 0.1%, and preferably about 0.2% to about 8%, based on the weight of the urea. Greater amounts, such as 15 or 20% acid, based upon the weight of the urea, can also be used to achieve the desired results.

Reaction of the urea with the acid to form the first component is preferably, but not necessarily, conducted separately from the second component, rosin. If desired, however, the urea can be reacted with the acid while in admixture with the rosin.

The second component of the sizing composition comprises rosin. Optionally, the rosin can be modified with an organic carboxylic material such as an alpha, beta-unsaturated organic acid, an anhydride thereof, or mixtures of such acids and anhydrides. The alpha, beta-unsaturated acid can be, for example, an alpha, beta-unsaturated aliphatic acid generally containing from about 3 to 10, preferably from about 3 to 6 carbon atoms, for example, acrylic acid, maleic acid, maleic anhydride and fumaric acid.

In the sizing compositions of the present invention, the rosin may be used in "dry" form or may be partially or completely saponified. Different types of rosin, such as gum rosin, wood rosin, tall oil rosin, or their mixtures can be used.

The amount of alpha, beta-unsaturated organic acids, anhydrides and their mixtures, used to modify the rosin can vary from about 5 to 50 percent or more, based upon the weight of the rosin, preferably from about 5 to 30 percent, and most preferably about 15 percent. The modified rosin can also be made into a soap by methods known in the art, such as by adding sodium hydroxide, potassium hydroxide, or ammonium hydroxide to form an alkali metal or ammonium soap of the rosin acids.

In making the sizing composition by contacting the first component comprising urea and the aminopolycarboxylic acid with the second component comprising the rosin, it has been found that the most effective contacting of the components occurs when each is in the form of finely divided particles in either the liquid or solid state, or finely divided mixtures of liquids and solids.

The finely divided state of the respective components can be accomplished by subjecting the components to high shear agitation in a blender or mixing apparatus, such as a high speed Waring blender operating with a mixing element speed of about 10,000 to 25,000 rpm. The average diameter of the finely divided particles of the components can range from about 10 to 1000 microns, preferably from about 20 to 250 microns.

In combining the first and second components, effective sizing compositions can generally be obtained with about 25 to 85 weight percent of the first component, and from about 75 to about 15 percent of the second component in the sizing composition on a dry basis. In addition, the sizing composition generally contains at least about 25 percent and more commonly about 40 to 60 percent by weight of water.

Ambient conditions can be used in contacting the first and second components in a finely divided state. The contacting of the components can also be accomplished at elevated temperatures of about 100° C., to boil off the water, and maintaining the temperature at the boiling point of water until all water is removed. Other suitable procedures disclosing general aspects of preparing and combining sizing compositions which are also applicable to the present invention are disclosed in U.S. Pat. Nos. 4,022,634 and 4,141,750 both to Emerson et al and incorporated herein by reference.

The sizing agents of the present invention have a pH that is generally about 9 to 11 and a total acidity of at least about 1000 ppm. The total acidity is measured as the amount of sodium hydroxide, expressed as equivalent parts by weight of calcium carbonate, required to impart a pink color to a million parts of a phenolphthalein-containing sizing composition of the present invention, in accordance with the Hach Chemical Company Total Acidity Test (Ames, Iowa, Model AC-5 Acidity Test Kit).

The sizing composition may be employed as a pulp additive or as a surface sizing agent in the manufacture of cellulosic products. The precise amount of sizing composition necessary to produce optimum results can vary depending upon the type of pulp used and the desired properties of the finished product. It has been found that lesser amounts of the sizing composition produce substantially equivalent or superior results, with amounts of about 0.05 to 0.25 percent up to about 4 percent by weight on a dry basis, based upon the weight of fibers in the pulp slurry.

The examples which follow serve to illustrate various embodiments of the present invention. All parts and percentages are by weight unless otherwise indicated.

EXAMPLE 1

Conventional Sizing Agent Containing Formic Acid

The first component, i.e., the urea-acid reaction product, of the sizing agent was prepared by placing 500.0 grams of commercially available urea, 27.78 grams of 90% formic acid and 522.22 grams of water in a cooking vessel, subsequently applying heat while slowly agitating the contents until the mixture boiled at atmospheric pressure. Heating was stopped when the pH of the mixture reached 8.5.

To form the second component, i.e., the modified rosin component, 500.0 grams of commercially available tall oil rosin was melted in a cooking vessel. The temperature was raised to 180° C. and 0.80 grams of tetraethylenetetraamine was added slowly with agitation. The temperature was subsequently raised to 200° C. and 75.00 grams of fumaric acid was added. The mixture was maintained at 200° C. for 2½ hours after the addition of fumaric acid to substantially complete all reactions.

To form the sizing agent, 75.00 grams of water, 65.21 grams of the first component and 36.97 grams of a 50% aqueous solution of potassium hydroxide were placed in a high speed Waring blender. 75.00 grams of the second component, in the form of solid particles, was added to the contents of the blender and agitated for two minutes. The addition of the second component in this manner insured that the second component was. finely divided as it contacted the agitated first component.

The pH of the solution was then adjusted to 10.5 with 8.48 grams of a 50% aqueous solution of sodium hydroxide. The resulting solution was a 50% solids sizing agent useful in both pulp additive and surface sizing applications.

EXAMPLE 2

Ethylenediaminetetraacetic Acid/Formic Acid Sizing Agent

The first component was prepared by placing 500.0 grams of commercially available urea, 23.40 grams of 90% formic acid, 6.25 grams of ethylenediamenetetraacetic acid and 524.97 grams of water in a cooking vessel and subsequently applying heat while slowly agitating the contents until the reaction mixture boiled at atmospheric pressure. Boiling was continued until the pH of the solution, as determined by a pH meter, was 8.5.

The second component was prepared according to the procedure of Example 1. The sizing agent was prepared according to the procedure of Example 1, except 8.41 grams of a 50% aqueous solution of sodium hydroxide was required to adjust the pH of the mixture to 10.5. The resulting composition was a 50% solid sizing agent useful in both pulp additive and surface sizing applications.

EXAMPLE 3

Nitrilotriacetic Acid/Formic Acid Sizing Agent

A reaction between 4.03 grams of nitrilotriacetic acid, 24.97 grams of 90% formic acid, 500.0 grams of urea and 524 grams of water was completed according to the procedure of Example 1 to form the first component. The second component was also made in accordance with the procedure of Example 1.

To form the sizing agent, 75.00 grams of water, 63.94 grams of the first component and 38.24 grams of a 50% aqueous solution of potassium hydroxide were placed in a high speed Waring blender. 75.00 grams of the second component, in the form of solid particles, was added to the contents of the blender and agitated for 2 minutes.

The pH of the solution was then adjusted to 10.5 with 7.45 grams of a 50% aqueous solution of sodium hydroxide. The resulting composition was a 50% solids sizing agent useful in both pulp additive and surface sizing applications.

EXAMPLE 4

N-hydroxyethylethylenediaminetriacetic Acid (HEEDTA) /Formic Acid Sizing Agent A reaction between 5.99 grams of HEEDTA, 24.48 grams of 90% formic acid, 500.0 grams of urea and 525.57 grams of water was completed according to the procedure of Example 1 to form the first component. The second component was also made in accordance with the procedure of Example 1.

To form the sizing agent, 75.00 grams of water, 63.94 grams of the first component and 44.00 grams of a 50% aqueous solution of potassium hydroxide were placed in a high speed Waring blender. 75.00 grams of the second component, in the form of solid particles, was added to the contents of the blender and agitated for two minutes.

The pH of the solution was then adjusted to 10.5 with 3.93 grams of a 50% aqueous solution of sodium hydroxide. The resulting composition was a 50% solids sizing agent useful in both pulp additive and surface sizing applications.

EXAMPLE 5

Diethylenetriaminepentaacetic Acid (DTPA) /Formic Acid Sizing Agent

A reaction between 8.36 grams of DTPA, 22.34 grams of 90% formic acid, 500.0 grams of urea and 526.24 grams of water was completed according to the procedure of Example 1 to form the first component. The second component was also made in accordance with the procedure of Example 1.

To form the sizing agent, 75.00 grams of water, 63.94 grams of the first component and 44.00 grams of a 50% aqueous solution of potassium hydroxide were placed in a high speed Waring blender. 75.00 grams of the second component, in the form of solid particles, was added to the contents of the blender and agitated for two minutes.

The pH of the solution was then adjusted to 10.5 with 3.73 grams of a 50% aqueous solution of sodium hydroxide. The resulting composition was a 50% solids sizing agent useful in both pulp additive and surface sizing applications.

EXAMPLE 6

Nitrilotriacetic Acid - Containing Sizing Agent

A reaction between 25.00 grams of nitrilotriacetic acid, 500.0 grams of urea and 525.00 grams of water was completed according to the procedure of Example 1 to form the first component. No other acid was used. The second component was made in accordance with the procedure of Example 1.

To form the sizing agent, 75.00 grams of water, 63.94 grams of the first component and 38.26 grams of a 50% aqueous solution of potassium hydroxide were placed in a high speed Waring blender. 75.00 grams of the second component, in the form of solid particles, was added to the contents of the blender and agitated for two minutes.

The pH of the solution was then adjusted to 10.5 with 7.32 grams of a 50% aqueous solution of sodium hydroxide. The resulting composition was a 50% solids sizing agent useful in both pulp additive and surface sizing applications.

EXAMPLE 7

Ethylenediaminetetraacetic Acid (EDTA) Sizing Agent

A reaction between 25.00 grams of EDTA, 500.0 grams of urea and 525.0 grams of water was completed according to the procedure of Example 1 to form the first component. No other acid was used. The second component was made in accordance with the procedure of Example 1.

To form the sizing agent, 75.00 grams of water, 63.94 grams of the first component and 38.26 grams of a 50% aqueous solution of potassium hydroxide were placed in a high speed Waring blender. 75.00 grams of the second component, in the form of solid particles, was added to the contents of the blender and agitated for two minutes.

The pH of the solution was then adjusted to 10.5 with 7.09 grams of a 50% aqueous solution of sodium hydroxide. The resulting composition was a 50% solids sizing agent useful in both pulp additive and surface sizing applications.

EXAMPLE 8

To test the sizing agents produced from aminopolycarboxylic acids and conventional acids with those produced from conventional acids alone, samples of the products of Examples 1 through 5 were treated as follows. The sizing agents were diluted to 5% solids with 25 ppm $CaCO_3$ synthetic hard water of the following composition:

1000 milliliters deionized water
19 milligrams $CaSO_4.2H_2O$
20 milligrams $CaCl_2.2H_2O$
21 milligrams $NaHCO_3$ The turbidity of each sample with time was monitored with a Hach Model 2100A turbidimeter. In general, the lower the turbidity (measured in NTU) of the sample over time, the more effective the sizing agent in resisting hard water-induced precipitation.

Figure 2:
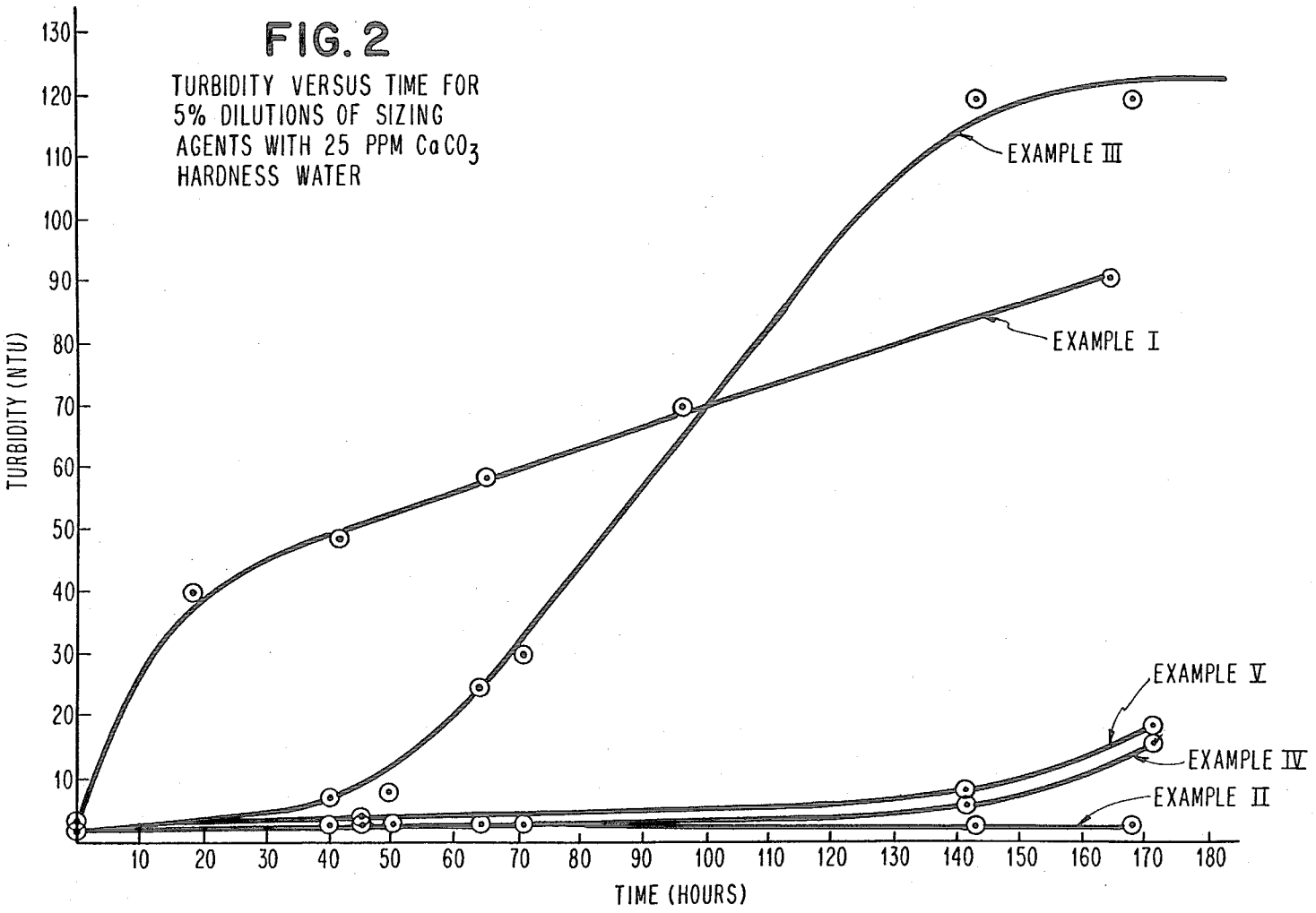

As illustrated in FIG. 2, the turbidity of each example varies with time, and the presence or absence of a specific aminopolycarboxylic acid. Example 1 demonstrates the usual development of turbidity in compositions that contain only conventional acids. Such sizing agents became visibly turbid within only a few hours after dilution with water even as low as 25 ppm $CaCO_3$ in hardness. Examples 2 through 5, however, demonstrated increased resistance to turbidity over conventional compositions. Example 2, the EDTA containing size, demonstrated superiority over the other embodiments.

EXAMPLE 9

To test the sizing agents produced from aminopolycarboxylic acids and complex acids with those produced from complex acids alone, samples of the products of Examples 6 and 7 were compared with the product of Example 1. The sizing agents were diluted to 5% solids with 100 ppm $CaCO_3$ synthetic hard water of the following composition:

1000 milliliters deionized water
77 milligrams $CaSO_4.2H_2O$
80 milligrams $CaCl_2.2H_2O$
84 milligrams $NaHCO_3$ The turbidity of each sample with time was monitored with a Hach Model 2100A turbidimeter. In general, the lower the turbidity (measured in NTU) of the sample over time, the more effective the sizing agent in resisting hard water-induced precipitation.

Figure 3:
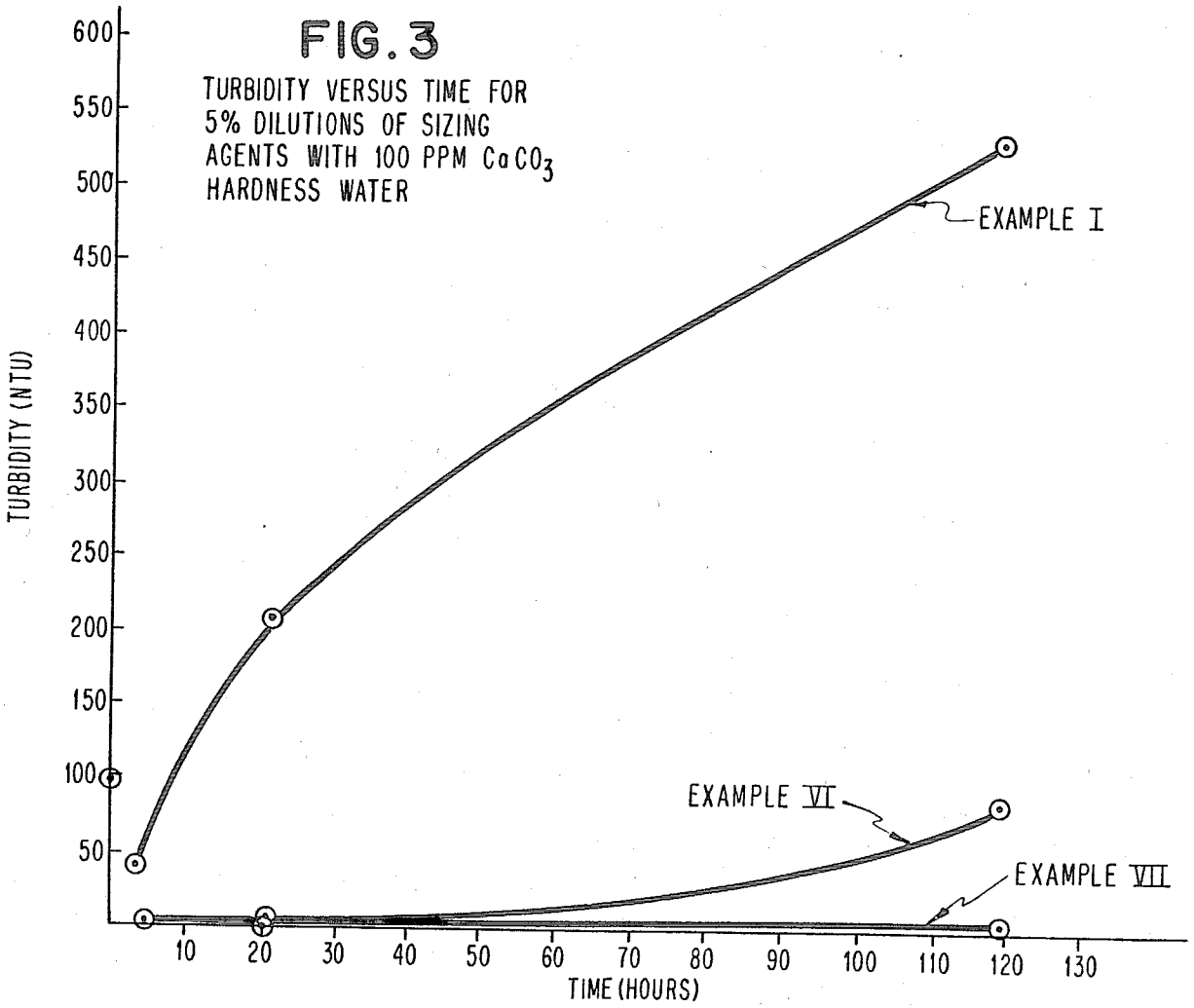

As illustrated in FIG. 3, the turbidity of each example varied with time, and the presence or absence of a specific aminopolycarboxylic acid. Example 1 demonstrates the usual development of turbidity in compositions that contain only conventional acids. Such sizing agents became visibly turbid within only a few hours after dilution with water 100 ppm $CaCO_3$ in hardness. Examples 6 and 7, however, demonstrated increased resistance to turbidity over conventional compositions Example 7, the EDTA containing size, demonstrated superiority over the other embodiments.

What is claimed is:

1. An internal sizing composition resistant to hard water precipitation consisting essentially of, on a dry basis:

(a) about 25 to 85 weight % of a reaction product of urea and an aminopolycarboxylic acid, said reaction product containing about 0.1 to 20 weight % of said aminopolycarboxylic acid based on the weight of the urea; and (b) about 15 to 75 weight % of a rosin.

2. The composition of claim 1, wherein the reaction product contains about 0.2 to 8 weight % of the aminopolycarboxylic acid based on the weight of the urea.

3. The composition of claim 1, which includes at least about 25% by weight of water.

4. The composition of claim 3, which includes about 40 to 60% by weight of water.

5. The composition of claim 1, wherein the aminopolycarboxylic acid is selected from the group consisting of ethylenediaminetetraacetic acid (EDTA), diethylenetriaminepentaacetic acid (DTPA), N-hydroxyethylethylenediaminetriacetic acid (HEEDTA), nitrilotriacetic acid (NTA), and mixtures thereof.

6. The composition of claim 1, wherein a second acid selected from the group consisting of carboxylic acids without an amino molity, inorganic acids, Lewis acids and mixtures thereof, is substituted for a portion of the aminopolycarboxylic acid.

7. The composition of claim 6, wherein said substituted acid is selected from the group consisting of formic, acetic, trichloroacetic, oxalic, stearic, hydrochloric, sulfuric, sulfamic, nitric, phosphoric, methanesulfonic, sulfuryl chloride, chlorosulfonic, thionyl chloride, benzenesulfonyl chloride, benzenesulfonic, ortho- or para-toluenesulfonic, ortho- or para-toluenesulfonyl chloride, and mixtures thereof.

8. The composition of claim 5, wherein said aminopolycarboxylic acid is EDTA.

9. The composition of claim 5, wherein said aminopolycarboxylic acid is DTPA.

10. The composition of claim 5, wherein said aminopolycarboxylic acid is HEEDTA.

11. The composition of claim 5, wherein said aminopolycarboxylic acid is NTA.

12. The composition of claim 1, wherein the rosin is saponified, partly saponified or unsaponified.

13. The composition of claim 12, wherein the rosin is modified with an organic acidic material selected from the group consisting of alpha, beta-unsaturated aliphatic carboxylic acids containing about 3 to 10 carbon atoms, anhydrides thereof, and mixtures of said acids and anhydrides.

14. The composition of claim 3, wherein the water is hard water whose hardness is determined from its calcium and magnesium concentration, expressed as an equivalent quantity of $CaCO_3$, and varies in hardness from about 10 to 500 parts per million $CaCO_3$.

15. The composition of claim 1, wherein the amount of aminopolycarboxylic acid is calculated in accordance with the following equation:

$$A = \frac{10\,(100 - B/C)\,D}{(B/C)\,EF}$$

where

A = required percent aminopolycarboxylic acid in urea/acid reaction product,

B = dilution concentration,

C = solids fraction of sizing composition,

D = water hardness,

E = % urea/acid reaction product in composition, and

F = chelating activity of selected aminopolycarboxylic acid.

16. The composition of claim 6, wherein the amount of second acid is calculated in accordance with the following equation:

$$X = (Y - Z/W)T$$

where

X = grams of second acid required to reach a given total acidity,

Y = total acid equivalents represented by quantity of acid, X,

Z = grams of chelate required for stable dilution,

W = equivalent weight of the chelate, and

T = equivalent weight of the second acid.

17. A method for preparing an internal sizing composition resistant to hard water precipitation, comprising:

(a) preparing, on a dry basis, a first component comprising about 25 to 85 weight % of a reaction product of urea and an aminopolycarboxylic acid, said reaction product containing about 0.1 to 20 weight % of said aminopolycarboxylic acid based on the weight of the urea, and (b) preparing, on a dry basis, a second component comprising about 15 to 75 weight % of a rosin, and (c) contacting the first component with the second component to form the sizing composition.

18. The method of claim 17, wherein the reaction product contains about 0.2 to 8% of the aminopolycarboxylic acid based on the weight of the urea.

19. The method of claim 17, wherein the aminopolycarboxylic acid is selected from the group consisting of ethylenediaminetetraacetic acid (EDTA), diethylenetriaminepentaacetic acid (DTPA), N-hydroxyethylethylenediaminetriacetic acid (HEEDTA), nitrilotriacetic acid (NTA), and mixtures thereof.

20. The method of claim 17, wherein a second acid selected from the group consisting of carboxylic acids, without an amino molity, inorganic acids, Lewis acids and mixtures thereof, is substituted for a portion of the aminopolycarboxylic acid.

21. The method of claim 20, wherein said substituted acid is selected from the group consisting of formic, acetic, trichloroacetic, oxalic, stearic, hydrochloric, sulfuric, sulfamic, nitric, phosphoric, methanesulfonic, sulfuryl chloride, chlorosulfonic, thionyl chloride, benzenesulfonyl chloride, benzenesulfonic, ortho- or para-toluenesulfonic, ortho- or para-toluenesulfonyl chloride, and mixtures thereof.

22. The method of claim 19, wherein said aminopolycarboxylic acid is EDTA.

23. The method of claim 19, wherein said aminopolycarboxylic acid is DTPA.

24. The method of claim 19, wherein said aminopolycarboxylic acid is HEEDTA.

25. The method of claim 19, wherein said aminopolycarboxylic acid is NTA.

26. The method of claim 17, wherein the rosin is saponified, partly saponified or unsaponified.

27. The method of claim 26, wherein the rosin is modified with an organic acidic material selected from the group consisting of alpha, beta-unsaturated aliphatic carboxylic acids containing about 3 to 10 carbon atoms, anhydrides thereof, and mixtures of said acids and anhydrides.

28. The method of claim 17, wherein said sizing composition is diluted with hard water varying in hardness from about 10 to 500 parts per million $CaCO_3$ prior to being used in a papermaking operation.

29. The method of claim 17, wherein the minimum total acidity is at least about 1000 to about 4000 parts per million.

30. The method of claim 17, wherein the amount of aminopolycarboxylic acid is calculated in accordance with the following equation:

$$A = \frac{10\,(100 - B/C)\,D}{(B/C)\,EF}$$

where

A=required percent aminopolycarboxylic acid in urea/acid reaction product,

B=dilution concentration,

C=solids fraction of sizing composition,

D=water hardness,

E=% urea/acid reaction product in composition, and

F=chelating activity of selected aminopolycarboxylic acid.

31. The method of claim 20, wherein the amount of second acid is calculated in accordance with the following equation:

$$X=(Y-Z/W)T$$

where

X=grams of second acid required to reach a given total acidity,

Y=total acid equivalents represented by quantity of acid, X,

Z=grams of chelate required for stable dilution,

W=equivalent weight of the chelate, and

T=equivalent weight of the second acid.

32. The method of claim 17, wherein the contacting of the urea-aminopolycarboxylic acid reaction product and the rosin is accomplished with at least about 25% by weight of weight to form an aqueous mixture.

33. The method of claim 32, wherein the contacting is accomplished with about 40 to 60% by weight of water.

34. The method of claim 32, wherein the water is hard water varying in hardness from about 10 to 500 parts per million $CaCO_3$.

* * * * *

UNITED STATES PATENT AND TRADEMARK OFFICE

CERTIFICATE OF CORRECTION

PATENT NO. : 4,699,663

DATED : October 13, 1987

INVENTOR(S) : George F. Feeney, III

It is certified that error appears in the above-identified patent and that said Letters Patent is hereby corrected as shown below:

At column 4, line 1, change "o" to --of--.

In the formula at column 5, line 46, change "t" to --T--.

In claim 6, line 3, at column 11, line 21, and in claim 20, line 3, at column 12, line 40, change "molity" to --moiety--.

In claim 32, line 4, at column 14, line 18, change "wait" (second occurrence) to --water--.

Signed and Sealed this

Thirteenth Day of June, 1989

*Attest:*

*Attesting Officer*

DONALD J. QUIGG

*Commissioner of Patents and Trademarks*